United States Patent [19]

DeLuca et al.

[11] Patent Number: 4,952,927

[45] Date of Patent: Aug. 28, 1990

[54] PAGING RECEIVER WITH DYNAMICALLY ALLOCATED DISPLAY RATE

[75] Inventors: Michael J. DeLuca; Joan S. DeLuca, both of Boca Raton; John M. McKee, Coral Springs, all of Fla.

[73] Assignee: Motorola, Inc., Schaumburg, Ill.

[21] Appl. No.: 388,758

[22] Filed: Aug. 3, 1989

Related U.S. Application Data

[63] Continuation of Ser. No. 81,762, Aug. 5, 1987, abandoned.

[51] Int. Cl.[5] ..... G08B 5/22

[52] U.S. Cl. ..... 340/825.440; 340/311.1; 340/792

[58] Field of Search ..... 340/825.44, 825.48, 340/311.1, 723, 724, 726, 789, 792; 358/288; 434/160, 169, 179; 364/518, 521

[56] References Cited

U.S. PATENT DOCUMENTS

| | | | |
|---|---|---|---|
| 3,432,846 | 3/1969 | Jones et al. | 340/792 |
| 3,838,139 | 2/1976 | Day | 340/792 |
| 3,976,995 | 8/1976 | Sebestyen | 340/792 |
| 4,007,443 | 2/1977 | Bromberg et al. | 340/792 |
| 4,160,242 | 7/1979 | Fowler et al. | 340/711 |
| 4,394,649 | 7/1983 | Suchoff et al. | 340/711 |
| 4,646,081 | 2/1987 | Tsunoda | 340/825.44 |
| 4,660,032 | 4/1987 | Tsunoda | 340/825.44 |

OTHER PUBLICATIONS

Collier, "How to Read Super Fast", Parade, Dec. 23, 1979, pp. 10–11.

*Primary Examiner*—Donald J. Yusko
*Assistant Examiner*—Edwin C. Holloway, III
*Attorney, Agent, or Firm*—Daniel R. Collopy; Vincent B. Ingrassia

[57] ABSTRACT

A paging receiver has a predetermined number of displayable characters, a microcomputer for receiving and processing data messages, a plurality of control switches for operating the computing means, and a memory for storing a plurality of received data messages. The microcomputer selects a data message to display from the memory, arranges the data message into a plurality of screens, computes an individual variable screen timeout value for each screen, and displays each screen on the display in a predetermined order for the screen timeout value computed. The screen timeout value computed on the basis of the message content of the screen, the presence of control characters in the data message, or the generation of input signals from the control switches. The screens can be displayed in a forward direction or a reverse direction. Each direction can either be a fast or a slow rate.

37 Claims, 12 Drawing Sheets

DISPLAY PANEL
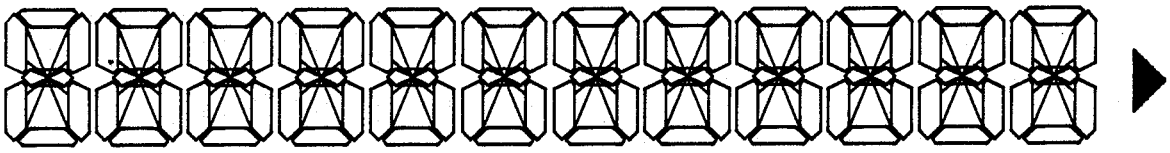
FIG. 2A
FIG. 2B
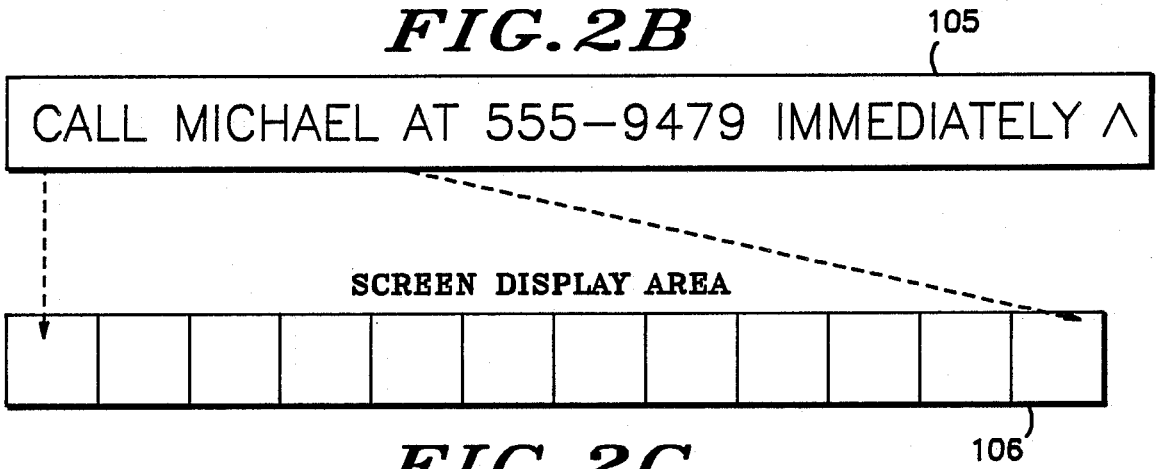
FIG. 2C
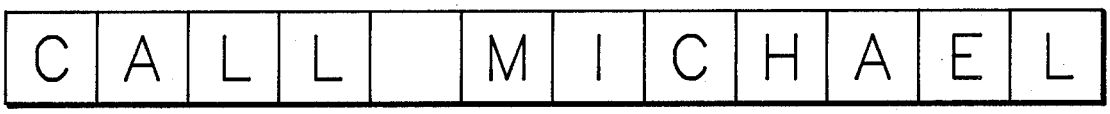
FIG. 3A
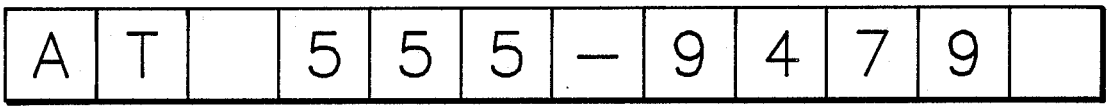
FIG. 3B
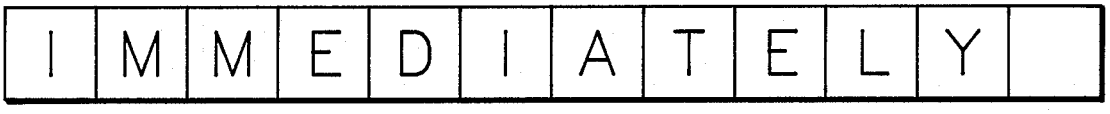
FIG. 3C

PAGING RECEIVER WITH DYNAMICALLY ALLOCATED DISPLAY RATE

This is a continuation of application Ser. No. 07/081,762 filed on Aug. 5, 1987, now abandoned.

BACKGROUND OF THE INVENTION

1. Field of the Invention

The present invention relates to communication systems and more particularly to a communication receiver such as a paging receiver for receiving, storing, and displaying paging information.

2. Background Discussion

Communication systems in general and paging systems in particular using transmitted call signals having attained widespread use for calling selected receivers to transmit information from a base station transmitter to the receivers. Modern paging receivers have achieved multifunction capabilities through the use of microcomputers which allow the paging receiver to respond to information having various combinations of tone, tone and voice, or data messages. The information is transmitted using any number of paging coding schemes and message formats. Additionally, these prior art paging receivers also provide such features as storing the data messages in a memory of the paging receiver for allowing the user to recall messages at a later time. Other features have been the ability of paging receivers to selectively recall a message and display it for the paging user.

A typical prior art memory display pager stores a plurality of received data messages in a memory of the paging receiver. A particular problem with these prior art paging receivers is a situation when the word length of a message exceeds the capacity of the display due to the small space available for the display. In these prior art paging receivers, such as U.S. Pat. No. 3,976,995, one remedy is to display a portion of the received message at a time and then marquee the message on a per-character basis from one end of the display array towards the other. However, this type of marqueeing demands rapid eye movement and renders the message less intelligible than information perceived on a per-word or word group basis.

Other prior art paging receivers, such as U.S. Pat. No. 4,646,081, display a portion of the received message as a screen at a time and then scrolls the message on a per screen basis in a fixed order where each screen contains a different portion of the message. However, the screen may contain broken word formats or clipped words which creates difficult reading for the user. Furthermore, this type of scrolling has been done at a constant scroll rate without regard to the informational content of the screen. Since each screen may contain different information, the paging user has been required to scroll through the screens repeatedly to perceive all the information in the message.

SUMMARY OF THE INVENTION

It is therefore an object of the present invention to overcome the problems of the prior art paging receivers by providing an adjustable or variable scroll rate for the screens comprising a displayed message.

It is another object of the present invention to provide an individual variable screen timeout for each screen of a message, the variable timeout being either user selectable, dynamically allocated, or dependent on message content to render the message more intelligible.

It is yet another object of the present invention to provide a forward direction to display the screens, a reverse direction being the opposite of the forward direction, a fast forward and a fast reverse.

These, as well as other objects and advantageous features of the present invention, will be apparent and, in part, pointed out hereinafter.

In general, a communication receiver, such as a paging receiver, for receiving information includes a receiving means, a decoding means, a memory means, a display means, and an alerting means. The receiving and decoding means receives information signals, including at least one data message, decodes the information signals for acquiring the data message, and stores the data in the memory means. The memory means includes a plurality of memory storage areas for storing a corresponding received data message and a screen display area having storage for the maximum number of characters that can be displayed on the display means. The decoding means includes a computing means which determines the complexity of the information content of a particular message to be displayed. Depending upon the complexity of the information contained in the message, the computing means separates the message into a plurality of screens and computes a variable screen timeout value for each screen. Each screen is displayed for the timeout period computed until all the screens are displayed. The screens can be displayed in a forward or a reverse direction and stored for later recall. In particular, the screen timeout value is computed, depending on either the message content, a user request input, a code plug memory variable or control signals embedded in the received data message.

In general, the method of computing the screen timeout value begins with separating the message into a plurality of screens, each screen comprised of a sequence of characters and being formatted to avoid broken or clipped words. The first sequence of characters are analyzed to compute the screen timeout value. After the first sequence of characters in the first screen are displayed for the screen timeout value computed by the control means, a second sequence of characters in a second screen are read from memory and the computing means computes a separate second screen timeout value for displaying the second screen. This continues until all the screens are displayed and thus displaying the entire message. Additionally, in response to user input, the order of the screens can be reversed to display the message in reverse. Furthermore, depending upon the information content of the message, the computing means displays the sequence of characters in word groups to prevent the display of part of one word in one sequence of characters then displaying the second part of the word in a subsequent sequence of characters.

BRIEF DESCRIPTION OF THE DRAWINGS

For the purpose of illustrating the invention, there is shown in the drawings an embodiment which is presently preferred, it being understood, however, that the invention is not limited to the precise arrangement and instrumentality shown.

FIG. 2A illustrates a typical thirteen segment display panel for displaying alphanumeric characters.

FIG. 2B is an illustration of a received message stored in a memory storage area of the data memory of FIG. 1.

FIG. 2C is an illustration of a screen display area of the present invention.

FIGS. 3A–C illustrate a plurality of screens, each having a sequence of characters generated from the illustrative message of FIG. 2B useful in explaining the operation of the present invention.

DETAILED DESCRIPTION OF A PREFERRED EMBODIMENT

In order to best illustrate the utility of the present invention, it is described in conjunction with a communication receiver, such as a paging receiver, capable of receiving and decoding information, the information including at least one data message, storing the data message, and displaying the data message. The detailed illustrative embodiments of the invention disclosed herein exemplify the invention and are currently considered to be the best embodiments for such purposes. However, while the present invention is described hereinafter with particular reference to a paging receiver, it is to be understood at the outset of the description which follows it is contemplated that the apparatus and methods in accordance with the present invention may be used with numerous other communication receivers.

The paging receiver described herein is associated with a paging system having a base station terminal, response to control and data information from the base station terminal, and in turn, stores and provides data messages to a user during operation.

With reference to the drawings in general, there is illustrated a paging receiver 10 and the method in one form of the invention of generating a variable scroll rate to display a data message comprised of a plurality of display screens, each screen being displayed for a variable display period or variable screen timeout value based upon such factors as message content. In another form of the invention, a screen timeout value is based upon control characters included within the message. In another form of the invention, there is disclosed a method of the present invention which includes a method for computing a screen timeout value as a function of user input or as a function of an external control signal. In particular, the control signal may take the form of a control word in a code plug memory or the receipt of a control word in the received information. Finally, the screen timeout value may be computed as a combination of message content, external control signal or embedded control characters within the received message.

I. General Description of a Paging Receiver

Figure 1:
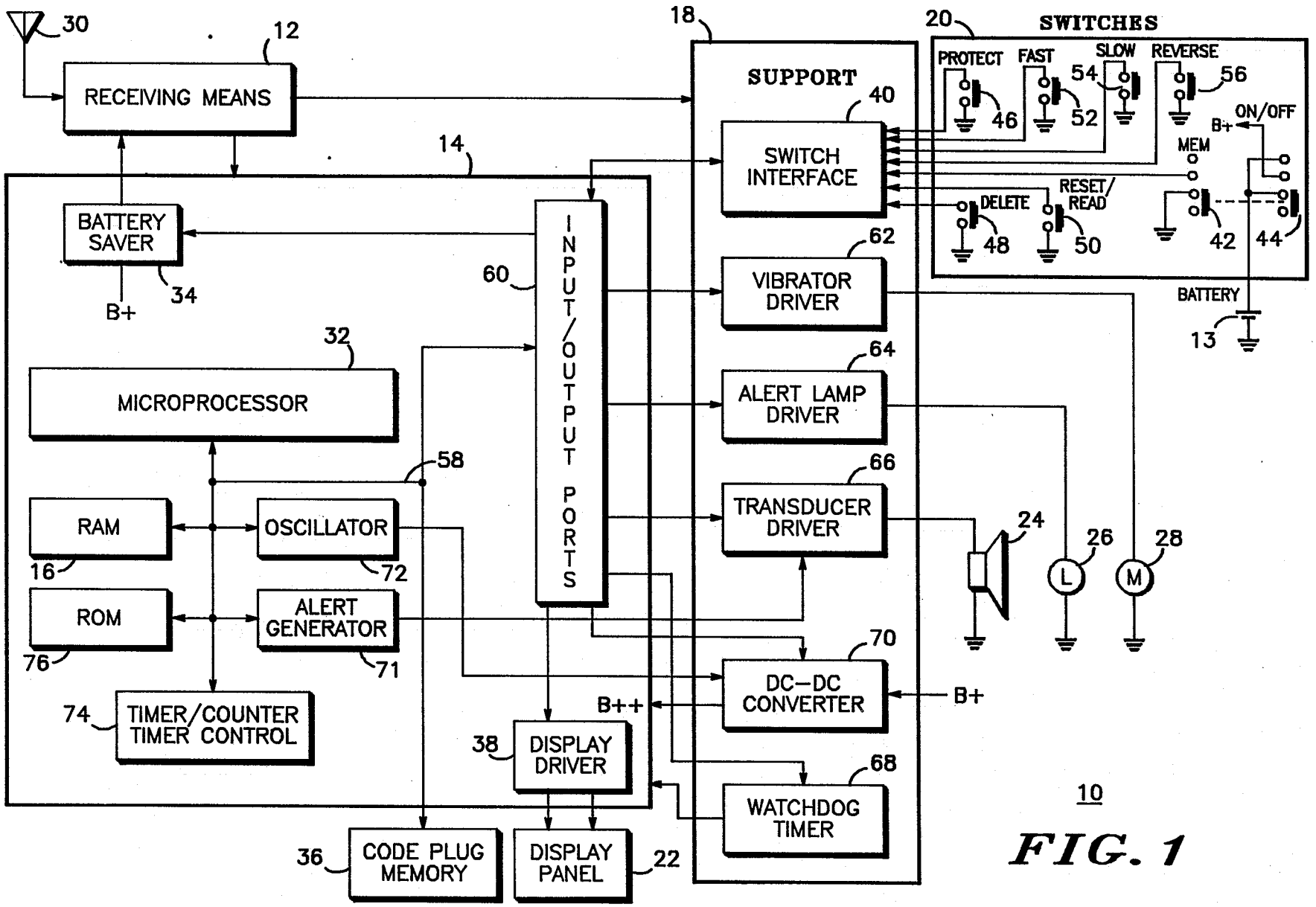
FIG. 1 is a schematic diagram of a typical paging receiver embodying the present invention.

More particularly, and with specific reference to FIG. 1, there is shown a paging receiver 10 including a receiving means 12, a decoding and computing means 14, a memory means 16, a support unit 18, a switching means 20, a display means 22, and an alerting means 24–28. In FIG. 1, an antenna 30 receives information, such as a paging signal. The paging signal includes control signals and data information for the paging receiver. The antenna 30 is coupled to receiving means 12 that is subject to the control of decoding and computing means 14 hereinafter referred to as decoding means. The decoding means 14 includes a microprocessor 32 that not only controls switching on and off receiving means 12, it may also operate receiving means 12 on an intermediate basis to extend the life of the battery 13 through battery saving circuit 34. Receiving means 12 outputs to decoding means 14 which has an address for comparing the received address words with an address contained in a code plug memory 36 to determine if the particular paging receiver has been activated and to prevent the paging receiver from functioning if it has not been activated.

More specifically, the code plug memory 36 is operatively coupled to the decoding means 14 such that when receiving means 12 receives paging codes and corresponding selective calling signals, the decoding means 14 actuates the code plug memory 36 and reads the unique coded contents thereof. If the received paging code matches the unique paging code from code plug memory 36, then the selective calling message associated with the received paging code is stored in memory means 16. Additionally, the code plug memory includes a predetermined screen timeout value which is accessible by decoding means 14.

It is noted that the paging receiver in FIG. 1 includes the capability of storing selective calling message signals in memory 16 and providing them to support unit 18 or to a display driver 38 for read out according to the state in which the switches of switching means 20 are set. A switch interface 40 provides I/O capability between switching means 20 and microprocessor 32. More specifically, the switching means 20 includes switches 42–44 for passing alert signals to alert annunciators 24, 26, and 28, switches 46–50 to control the storage, protection and retrieval of messages stored in memory 16, and switches 52–56 to control the scroll rate of display means 22. Furthermore, each switch generates an input signal to decoding means 14 in response to activation.

For example, the protect switch 34 generates an input signal to decoding means 14 which allows the user to select and protect a message location included in memory 16 from being destroyed. Switch 50 permits the user to read a particular memory location in memory 16. Upon activation, switch 48 allows the user to delete a message from a memory location included in memory means 16. Switches 42 and 44 allow the user to select one of the alerts 24–28 which typically comprise lights, light emitting diodes, speakers, or other annunciators. Switch 54 permits the user to increase the screen timeout value which decreases the scroll rate and thus increases the time a screen is displayed on display means 22. Up activation, switch 52 decreases the screen timeout value which increases the scroll rate and thus decreases the time a screen is displayed on display means 22. Finally, switch 56 reverses the order the screens are displayed on display means 22. In operation, switch 56 acts as a rewind function, allowing a user to quickly repeat the display of selected screens from a most recently displayed screen to a least recently displayed screen.

II. Operation of the Paging Receiver

The explanation now proceeds to the operation of the decoding means 14 which includes a microprocessor 32. Microprocessor 32 decodes the address data from the receiving means 12 in a known fashion and compares the result with the predetermined address contained in code plug memory 36 to produce output signals to process the message data, to store the message data, to alert the user that a message has been received, and to display the message to the user. The microprocessor 3 communicates through bus 58 with other elements of the paging2 receiver 10 via input/output ports 60. One of the output signals from the microprocessor 32 is supplied to a display driver 38 to produce an alphanumeric display of the data on display means 22 such as an LCD display panel 22. Display panel 22 typically has associated with it a predetermined number of alphanumeric display elements. One typical display element that may be used is an 13-segment liquid crystal display having 12 elements. Thus, 12 alphanumeric characters can be displayed at a time on display panel 22.

Other output signals from microprocessor 32 are supplied to a support unit 18 to selectively enable a vibrator driver 62, an alert lamp driver 64, or transducer driver 66. Other signals are applied to a battery saver unit 34, watchdog timer 68, DC-DC converter 70, and switch interface 40. Microprocessor 32 also controls an alert generator 71 which causes tones produced by transducer driver 66 to be applied to speaker 24.

A clock signal, derived from an oscillator 72, is applied to the microprocessor 32, such as an MCM68HC05C8 microprocessor manufactured by Motorola, Inc. to control the scroll rate at which data messages stored in memory 16 and comprised of a plurality of screens are displayed. It is understood that the microprocessor 32 uses oscillator 72 as well known in the art for controlling internal operation as well as its interface with other elements of the paging receiver 10 such as timer control 74. Timer control 74 provides microprocessor 32 time and interrupt information for processing data in a manner well known in the art. Microprocessor 32 is coupled by a data bus 58 to a read only memory (ROM) 76 and by data bus 58 to memory means 16, such as a random access memory (RAM). RAM 16 includes a plurality of message storage areas and is adapted to store the data messages which microprocessor 32 converts from the received encoded paging information signals and to process these signals including decoding, to appropriately store the data messages in designated memory location areas of RAM 16, and to display the data messages on display panel 22. Some of the programs or routines to operate microprocessor 32 are not important for the understanding of the present invention and are not described in detail. However, the programs and routines to display the data messages on display panel 22 and compute the variable scroll rate are stored in ROM 76 and are explained generally with respect to FIGS. 5–14.

In the paging receiver 10, the data messages received and decoded are stored by microprocessor 32 in message storage areas of RAM 16. The messages are retrieved by the user by notifying the microprocessor 32 through the process of activating the read switch 50 to read appropriate memory storage areas and to display the message via display driver 38 on display panel 22. Once the message is stored in memory, the paging user may desire to continue such storage and to defer message readout.

Alternately, the user may desire to interrogate memory 16 to determine if any messages have been stored therein while the paging receiver was selected for later readout when so instructed by switches 42 and 44. To initiate such interrogation to read out memory 16, the paging user activates switch 50 to cause the microprocessor 32 to read a memory location out of memory 16. The microprocessor 32 then arranges the characters of the data message into a plurality of screens in a predetermined order, each screen being comprised of a sequence of characters from the data message. The sequence of characters in a screen are arranged for display on the elements of display panel 22 for easy interpretation of the data message by the paging user. The microprocessor 32 then computes a separate screen timeout value for each screen and displays the screen for the screen timeout value computed. The entire data message is displayed by scrolling through the screens. The subsequent activation of read switch 50 causes microprocessor 32 to step through plural population of memory storage areas displaying their contents. Additionally, activating the read switch 50 during display of a screen holds or "freezes" the screen.

In one form of the present invention, additional switches 52 and 54 enable the user to increase and decrease respectively the scroll rate of the data message on display. A reverse switch 56 permits the screens to be displayed in a reverse order. For example, if the nth screen is being displayed for a message, activating the reverse switch displays the $n-1$, $n-2$, . . . screens in that order until the switch is deactivated. In addition, after reading the data messages, the user can either delete the message by activating the delete switch 48 or protect the message from destruction by activating the protect switch 46.

It is noted that the description of the pager operation given above is general in nature. More details of a pager operation are found in U.S. Pat. No. 4,412,217 entitled "Pager with Visible Display Indicating Display Status of Memory" assigned to the present assignee which disclosure is hereby incorporated by reference.

III. Operation of the Paging Receiver to Generate a Variable Scroll Rate

The explanation now proceeds to the operation of the microprocessor as described in the following flow charts to generate a variable scroll rate by computing a variable screen timeout value for each screen. The programs are stored in ROM 76 in a predetermined sequence to cause the operation of the microprocessor for operating on the data messages to store, arrange, recall and display messages in accordance with the following flow charts. Other routines for the operation of the microprocessor are included in the ROM, however, the routines are not described herein since they are not needed for the understanding of the present invention.

Referring to FIG. 2A, for clarity and purposes of illustration, a 13-segment display panel 22 having 12 elements is shown. One element for the display is capable of displaying a single alphanumeric character. As a simplified example of the operation of the microprocessor, consider now the display of the message as shown in FIG. 2B. FIG. 2B illustrates a message 105 "CALL MICHAEL AT 555-9479 IMMEDIATELY" stored in a message storage area 66 of memory 16. The ∩ signifies an end-of-message character. FIG. 2C illustrates a screen display area 106 being included in memory 16 and includes the same number of elements as display panel 22. Each storage location of screen display area is capable of containing an alphanumeric character in the form of an 8-bit ASCII character capable of being displayed on an element of display panel 22. It is to be pointed out while the present invention is described with particular reference to specific numbers for memory and elements for display 22, for purposes of illustration, it is contemplated that the apparatus and methods, in accordance with the present invention, may be used with numerous other variations in memory length and display panel elements.

For purposes of illustration, FIGS. 3A–C illustrate the operation of microprocessor 32 to convert the message 105 in the message storage area to a plurality of screens, each screen being labelled FIG. 3A–C. For example, FIG. 3A shows the first sequence of characters arranged in a word group "CALL MICHAEL" comprising the first screen. Similarly, FIG. 3B illustrates the second screen comprised of the second sequence of characters "AT 555-9479" from message 105. Finally, FIG. 3C illustrates the third sequence of characters "IMMEDIATELY" comprising the third screen. By way of example, reference is continually made to FIGS. 3A–C in the description which follows for clarity.

A. General Description

Figure 4:
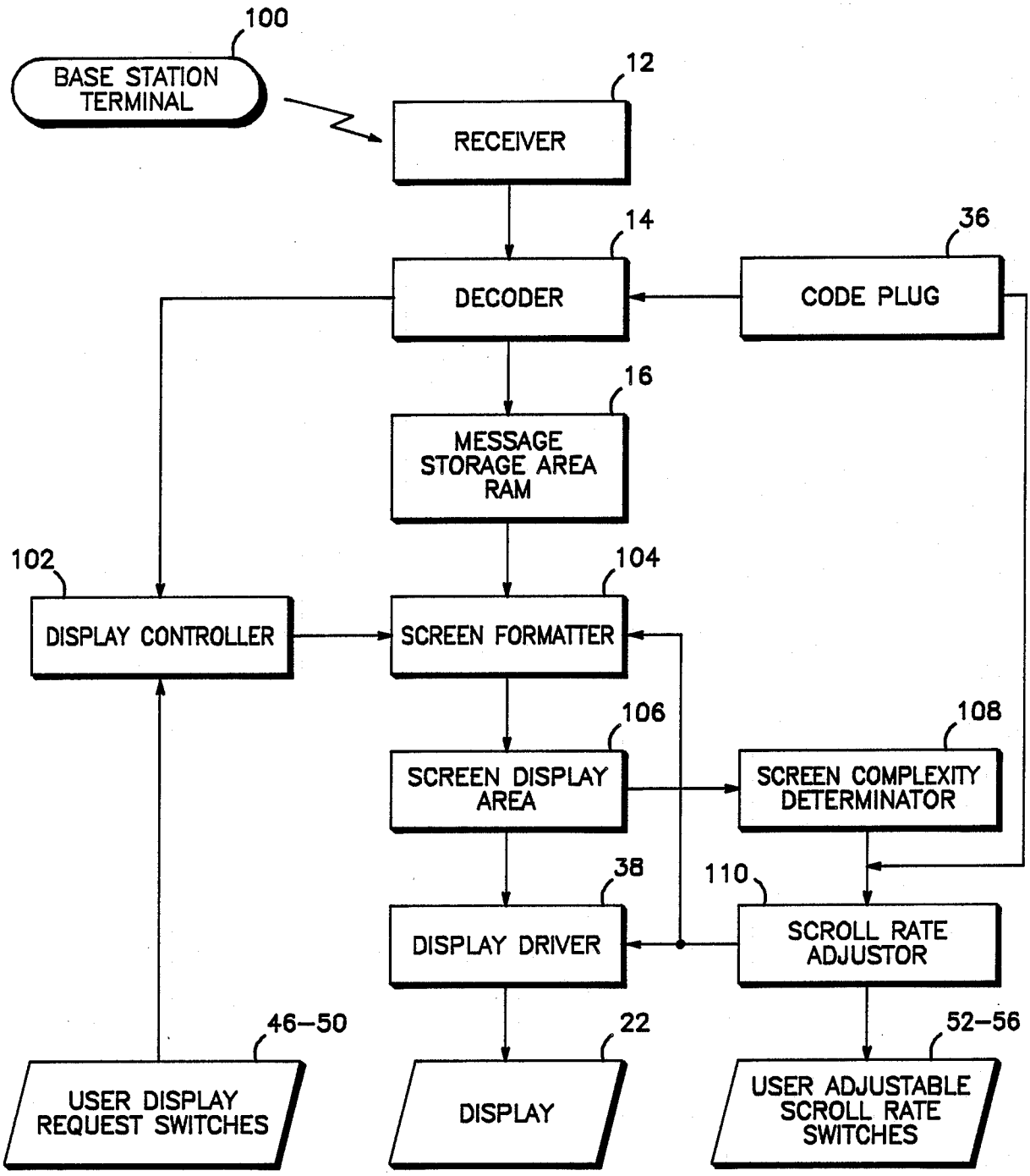
FIG. 4 is a block diagram of the operation of the paging receiver to display a message using a variable scroll rate.

Referring to FIG. 4, there is shown a block diagram of the paging receiver functions to display a message. It is to be understood that the functions of each block may be performed by the necessary digital hardware, such as counters, timers, and registers, to accomplish each function as described in a manner well known in the art. However, in the preferred embodiment, the functions are performed by software operating under control of microprocessor 32, a detailed discussion of which is described with reference to FIGS. 5–14.

Initially, receiving means 12 responds to information transmitted from a base station terminal 100. The decoder 14 receives information from receiver 12 and stores the data messages included in the information in message storage areas in memory 16. Additionally, the decoder 14 responds to control information from the code plug memory 36 and generates control signals for a display controller 102 which responds to user display request switches 46–50 to enable the user to selectively display any one of a plurality of messages stored in memory 16. In response to switches 46–50, the display controller 102 sends control signals to a screen formatter 104 which is responsive to a memory 16 operating under the control of decoder 14, user display switches 46–50, and user adjustable scroll rate switches 52–56. The screen formatter 104 receives the user display request and begins to format screens for the appropriate display of the message as a function of the user display request switches and the number of display elements included in the display 22. One of the objectives of the screen formatter is to arrange the screens into word groups to avoid broken word formats.

For example, referring to the illustration example of FIG. 2B, the received message 105 stored in a selected memory location of data memory includes the plurality of words "CALL MICHAEL AT 555-9479 IMMEDIATELY" in which the number of characters in the message are greater than the elements of display 22. One of the objectives of the screen formatter 104 is to arrange the words in a screen display area 106 as shown in FIG. 2C such that the words of message 105 are displayed on the display 22 in an easy, user friendly manner. Another objective of screen formatter 104 includes displaying words in an unbroken format such that a word is not dissected with a first part appearing in one screen and a second part appearing in the next screen. Once the screen formatter 104 selects the groupings of words or sequence of characters for each screen, a screen complexity determinator 108 scans the message content of a screen display area to determine the complexity of the message content of the screen. The complexity can be determined by character type or by words contained in the screen. The screen complexity determinator 108 generates a display time (screen timeout value) for the screen, depending upon the complexity of the screen, and transfers this information to a scroll rate adjustor 110.

The scroll rate adjustor 110 is responsive to code plug memory 36 and adjustable scroll rate control information generated by scroll rate control switches 52–56. The scroll rate control takes the form of input signals from the switches or code plug memory. The scroll rate adjustor 110 adjusts the screen timeout value from the screen complexity determinator and uses the information to send a screen timeout value to the display driver 38. Display driver 38 receives the screen timeout value from the scroll rate adjustor 110 and displays the characters contained in the screen on display panel 22 according to the screen timeout value generated by the scroll rate adjustor 110. In addition, the display driver 38 verifies a character in the screen display area to be a displayable character. If a character is a non-displayable character, such as a control character, the display driver eliminates the non-displayable character and shifts the remaining characters to eliminate any spaces left by the elimination of the non-displayable character.

B. Overall Display Operation

Figure 5:
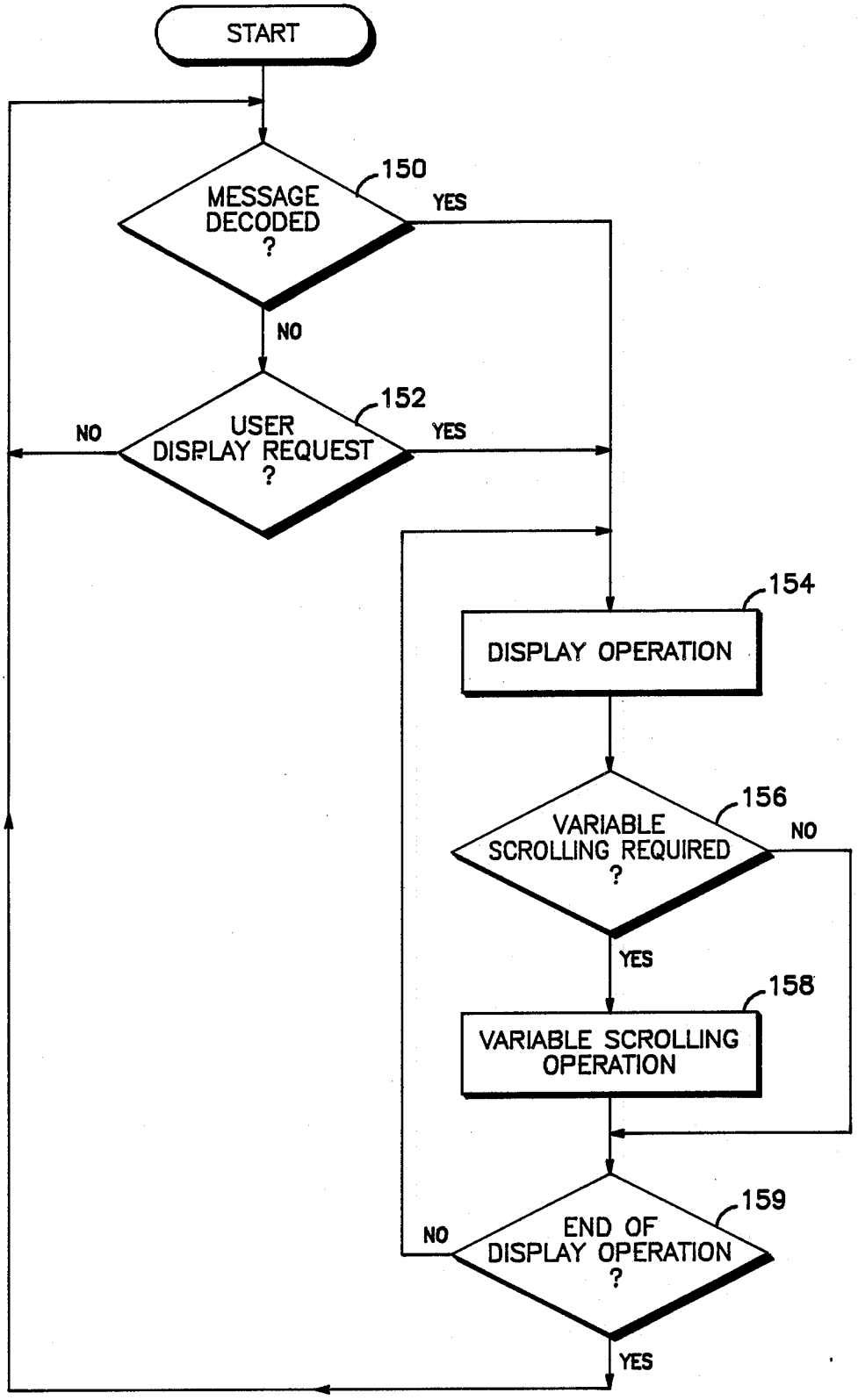
FIG. 5 is a flow chart describing the instructions of the microprocessor of FIG. 1 for performing the operation described in FIG. 4.

FIG. 5 shows a flow chart describing a method for the operation of the block diagram of FIG. 4. To begin, the method determines if a message has been decoded by the decoder 14, step 150. If a message is decoded, then the message is scheduled to be displayed on display 22, step 154. If a message has not been decoded, then the user display request switches are scanned to determine if the user desires to display a previously stored message, step 152. If the user does not desire to display a previously stored message, the method then returns to wait for incoming paging information. Referring back to step 154, if a message is scheduled for display, a display operation is executed. The display operation 154 may or may not require variable scrolling. A flag is detected which is stored in memory 16 which determines if variable scrolling is required, step 156. The flag can be set by activating the scroll rate switches or can be set by software control. If variable scrolling is required, the variable scrolling operation is scheduled and processed, step 158. The method then determines if this is the end of a display operation, and if so, returns to waiting for a message to be decoded, step 159. Referring to step 159, if this is not the end of the display operation, the system repeats the display operation beginning with step 154.

Figure 6:
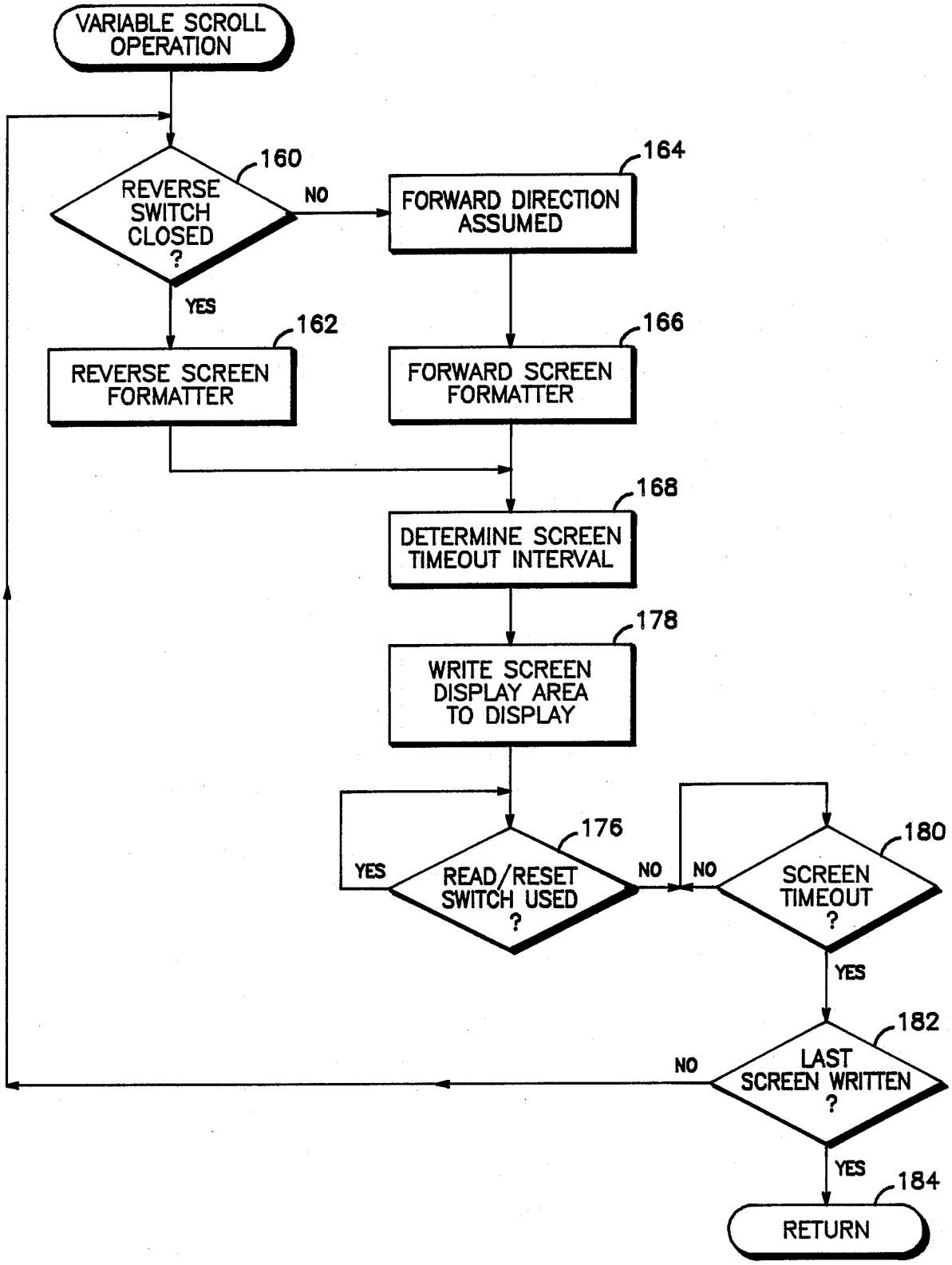
FIG. 6 is a flow chart describing the instructions of the microprocessor of FIG. 1 for generating a variable scroll rate.

Referring now to FIG. 6, there is shown a detailed flow chart diagram for the variable scrolling operation of step 158 of FIG. 5. An objective of the scroll operation 158 is to format the message into a plurality of screens. A screen is composed by the screen formatter 114 according to the message content of the message. The method begins by determining the order the screens are to be displayed. The screens can be ordered in either a forward or a reverse direction. The forward direction displays the screens in a typical left to right direction as one would read. The reverse direction is the reverse of the forward direction. By way of example, the forward direction would display the message 106 in the order as shown in FIG. 3A–FIG. 3B–FIG. 3C. The reverse direction would display the message 106 in the order as shown by FIG. 3C–FIG. 3B–FIG. 3A. For clarity, in the forward direction, the screens are ordered from 1, 2, . . . n, n+1,; while in the reverse direction, the screens are ordered n+1, n, . . . 2, 1.

The method first determines if the reverse switch is activated, step 160. If the reverse switch is activated, the screens are generated in the reverse direction, step 162. If the reverse switch is not activated, the forward direction is assumed, step 164. The screens are then generated in a forward direction, step 166. After the screens are ordered in either the forward or reverse direction, the screen timeout value is computed for the first screen to be displayed, step 168. Reference is made to FIGS. 9–14 for a detailed discussion of computing the screen timeout value.

Figure 12:
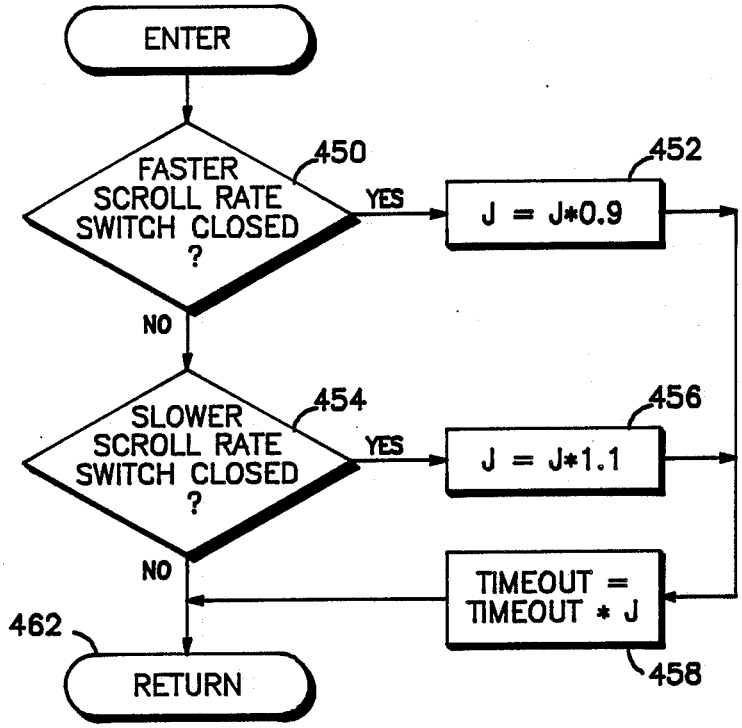
FIG. 12 is a flow chart showing a method for computing a user requested variable screen timeout value.
Figure 13:
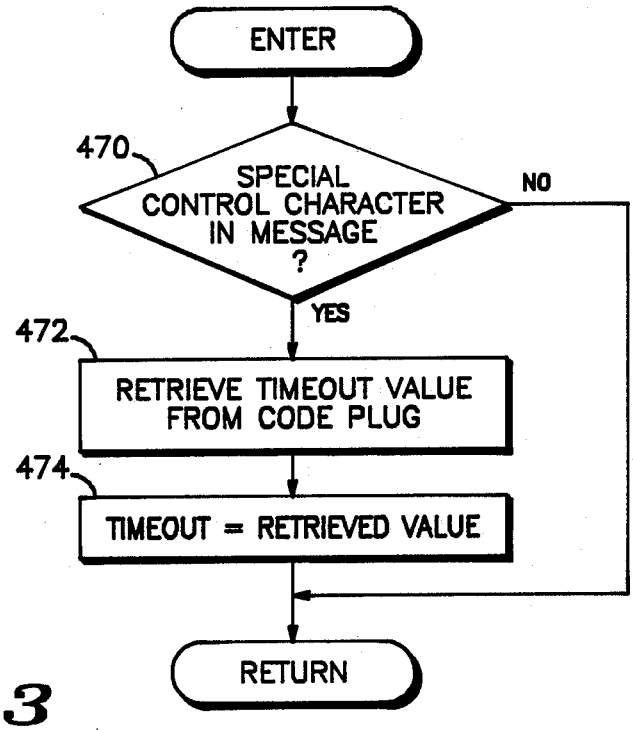
FIG. 13 is a flow chart illustrating a method for generating a variable screen timeout value based upon a predetermined value in the code plug memory.

It is briefly noted that in the method of computing the screen timeout value, the fast switch and the slow switch are scanned to determine if the scroll rate is to be increased or decreased respectively. If the fast switch is activated, the screen timeout value is decreased by a predetermined percentage or amount. Note that decreasing the screen timeout value increases the scroll rate. If the slow switch is activated, the screen timeout value is decreased by a predetermined percentage or amount. This increases the scroll rate. If neither the fast or slow switch is activated, the screen timeout value remains unchanged. Reference is made to FIG. 12 for a more detailed discussion.

Continuing, the method then displays the message content of the screen, step 178. The screen is then displayed for the screen timeout value computed previously, step 180. However, if the read/reset switch is activated, the screen being displayed is held or frozen, step 176. This allows the user to hold a screen on the display indefinitely. If the read switch is not activated and the screen timeout has expired, the method then determines if this is the last screen in the message, step 182. Eventually, the last screen is displayed and the system returns, step 184. Note that each time a screen is formatted, the direction of display is checked, steps 162 and 164. Thus, screens can be displayed in the order 1, 2, 3, . . . , p and then reversed p−1, p−−2, . . . 3, 2, 1 where p≦n. Thus, a user can at any time during the display of a message reverse the screen direction.

Considering the example in FIGS. 3A–C, the screen formatter 104 formats the first screen from message "CALL MICHAEL AT 555-9479 IMMEDIATELY" into "CALL MICHAEL", steps 160–166. The screen timeout interval is computed for the first screen, step 168. The screen is transferred to the display panel 22 by the display driver 38 to display "CALL MICHAEL" as shown in FIG. 3A, step 178. If the read switch is activated, the screen is held or frozen. The screen is displayed until the screen timeout interval elapses, step 180. Since two screens remain (FIGS. 3B–C), steps 160–182 are repeated until the last screen is displayed. It is important to note that each screen has a corresponding screen timeout interval which is independently computed for each screen. For example, as will be described hereinafter, the screen of FIG. 3A may have a timeout value of 1.11 seconds, the screen of FIG. 3B may have a timeout value of 2.17 seconds, and the screen of FIG. 3C may have a timeout value of 1.11 seconds.

C. Forward Format Screen Operation

Figure 7:
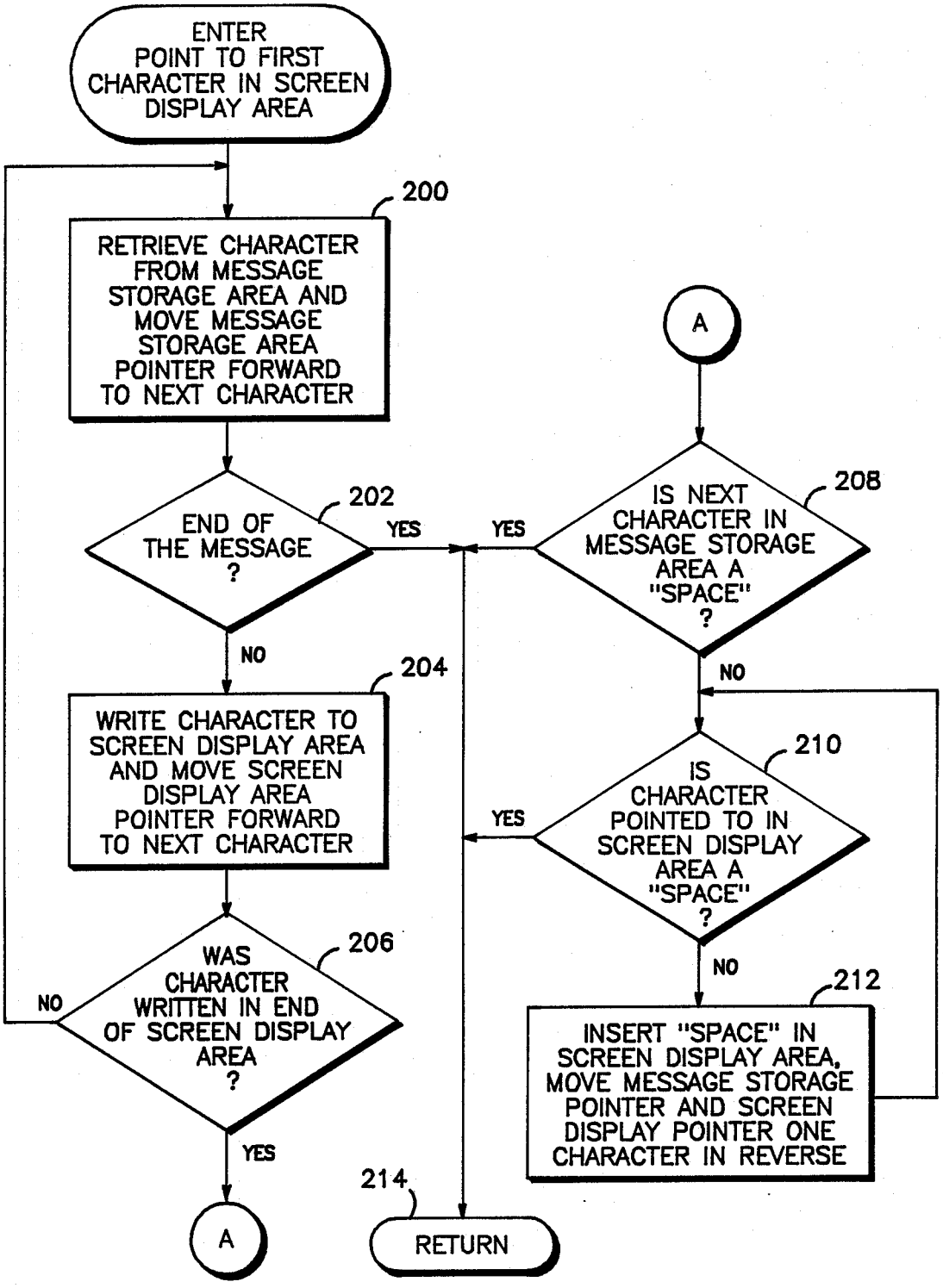
FIG. 7 is a flow chart describing the instructions of the microprocessor of FIG. 1 for formatting the screens in a predetermined order of a message to be displayed.

Referring to FIG. 7, there is shown a detailed flow chart of the forward format screen operation of step 166 of FIG. 6. The forward format screen operation formats the screens in a forward direction. To begin, the first character is retrieved from the message storage area, step 200. The character is tested to determine if this is an end-of-message character, step 202. If the character is not an end-of-message character, the character is transferred to the screen display area and a screen display area pointer is moved forward to the next character location, step 204. The screen display area is then checked to see if it is filled with characters, step 206. If the screen display area is not filled with characters, the method repeats steps 200–206, retrieving a character from the message storage area and writing it to the screen display area. Eventually, the screen display area will be filled or an end-of-message character will be reached.

Referring back to step 202, if an end-of-message character is detected, the method returns, step 214. Referring back to step 206, in the case of the screen display area becoming full, the system determines if the next character in the message storage area is a space character, step 208. If the next character in the message storage area is a space character, this signifies a break at the end of a word and that the screen display area contains unbroken words. If the next character in the message storage area is not a space, this implies that a word falls across screen boundaries. In this case, the method determines the end of the last unbroken word in the screen display area by moving the screen display area pointer back one character at a time, checking the character to see if the character is a space and replacing any non-space characters with a space to clear from the end of the last unbroken word in the screen display area, steps 210–212. Eventually, a space will be found resulting in the next screen beginning with the first word after the space. The method then returns, step 214.

Considering the example of FIGS. 3A–C, the first sequence of characters from message storage area 68 comprise "CALL MICHAEL" (FIG. 3A). Since the first screen boundary coincides with a word boundary, the method will begin the next screen with the sequence "AT . . . " Since the next sequence begins with "AT 555-9479 IMMEDIATELY", the screen boundary will dissect the word "IMMEDIATELY" (FIG. 3C). Thus, the method will generate "AT 555-9479" (FIG. 3B) as the second screen and will begin the next screen with the sequence "IMMEDIATELY." Since the number of characters in "IMMEDIATELY" is less than the elements in the display panel and an end-of-message character is reached, the method terminates with the third screen comprising "IMMEDIATELY."

Considering the forward format screen operation in somewhat further detail, as each screen is formatted, it can be stored in memory 16. Additionally, the screen timeout value can be easily stored with the screen. Thus, a plurality of screens with or without the corresponding screen timeout value for each screen can be generated in a predetermined order, such as 1, 2, 3, . . . n, from the data message and stored in memory. As is evident, a message or a plurality of messages can then be stored on a screen-by-screen basis. As will be described, storing the screens during the forward format screen operation facilitates the displaying of the screens in a reverse direction, such as p, p−1, . . . 2, 1, where $p \leqq n$.

D. Reverse Format Screen Operation

Figure 8:
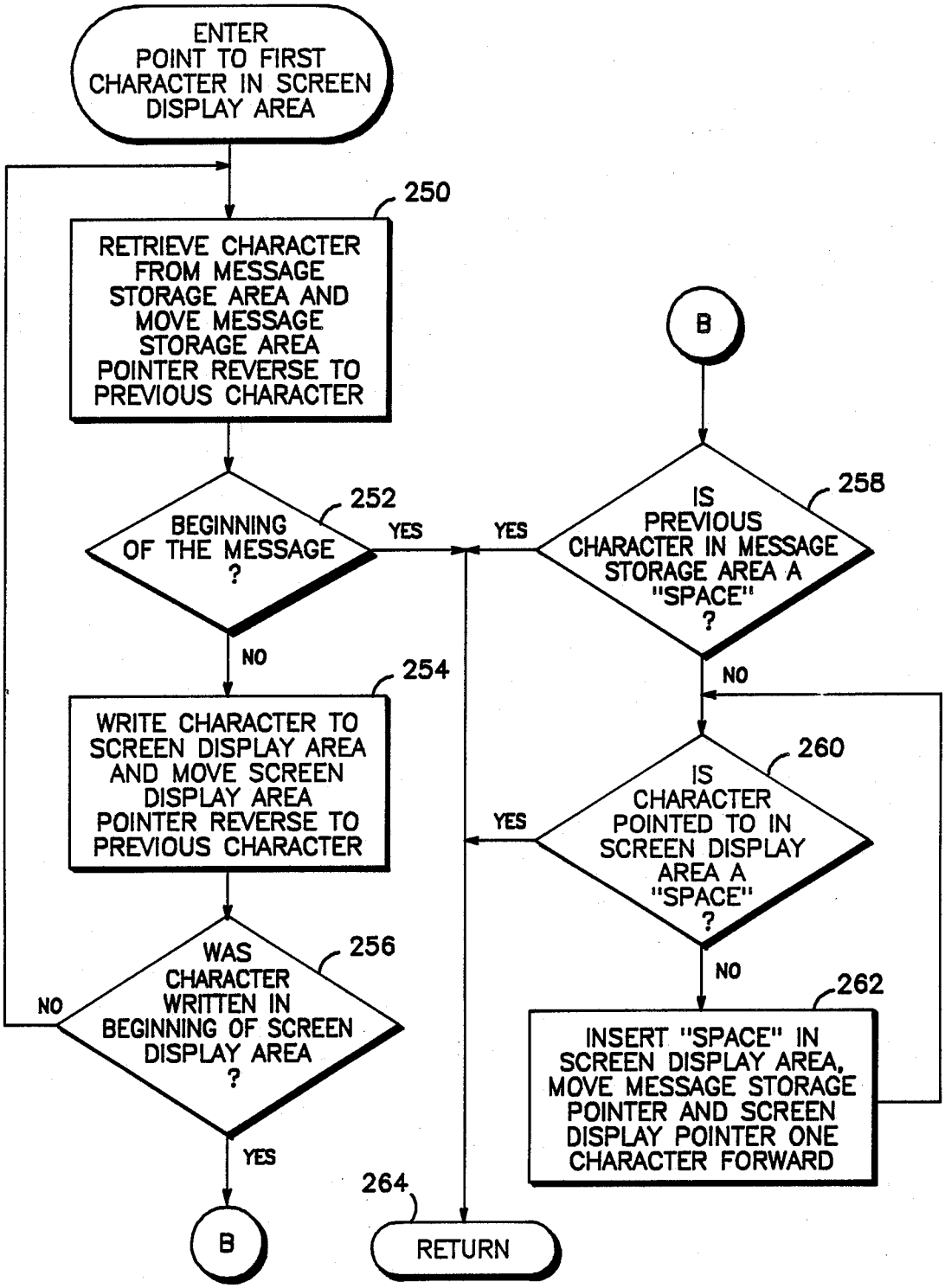
FIG. 8 is a flow chart describing the instructions of the microprocessor of FIG. 1 for formatting the screens in the reverse order of FIG. 7 for a message to be displayed.

Referring to FIG. 8, there is shown a detailed flow chart of the reverse format screen operation of step 162 of FIG. 6. The reverse format screen formats the screen in a reverse direction. To begin, the last character is retrieved from the message storage area, step 250. Additionally, the message storage area pointer is moved in the reverse direction to pick up the previous character. The character is then tested to determine if this is the beginning of the message, step 252. If the character is at the beginning of the message, the method returns, step 264. If the character is not at the beginning of the message, the character is transferred to the screen display area and the screen display area pointer is moved back to the previous character, step 254. The screen display area is then checked to determine if the character transferred is at the beginning of the screen display area, step 256. If the character transferred is not the beginning of the screen display area, the message storage area and writing it to the screen display area. Eventually, the screen display area will be filled or a beginning of message address will be reached. Referring back to step 252, if the beginning of message is detected, the method returns, step 264. Referring back to step 256, in the case of the screen display area becoming full, the method determines if the previous character in the message storage area is a space character, step 258. If the previous character in the message storage area is a space character, this signifies a break at the end of a word and that the screen display area contains unbroken words. If the next character in the message storage area is not a space, this implies that a word falls across screen boundaries. In the case of the word falling across screen boundaries, the method determines the beginning of the last unbroken word in the screen display area by moving the screen display pointer forward one character at a time, checking the character to see if the character is a space, replacing any non-space characters with a space to clear the last unbroken word in the screen display area and left justifying the word group in the screen, steps 260–262. The method then returns, step 264.

Considering the examples of FIGS. 3A–C, the reverse format operation will compute for the first sequence of characters from the message storage area of 105 to be comprised of "IMMEDIATELY" (FIG. 3C). The next sequence of characters for screen 2 will comprise the words "AT 555-9479" (FIG. 3B). Finally, the method will generate "CALL MICHAEL" (FIG. 3A) as the last screen.

As was explained with reference to FIG. 7, the screens can be previously stored in the forward format screen operation. If the screens have been previously stored in a predetermined order, such as 1, 2, 3, . . . n−1, n, the reverse operation can be greatly simplified by recalling the stored screens in a reverse order such as p, p−1, . . . 2, 1, where $p \leqq n$. In this case, the reverse format screen operation comprises recalling the screens from memory in a reverse order without having to individually generate each screen again. If the screen timeout value has also been previously stored, the screen can be immediately displayed since the screen timeout value will be independent of the direction the screens are formatted. However, if the screen timeout value has not been previously stored, the screen timeout value must be recomputed.

E. Computation of Variable Screen Timeout

Figure 9:
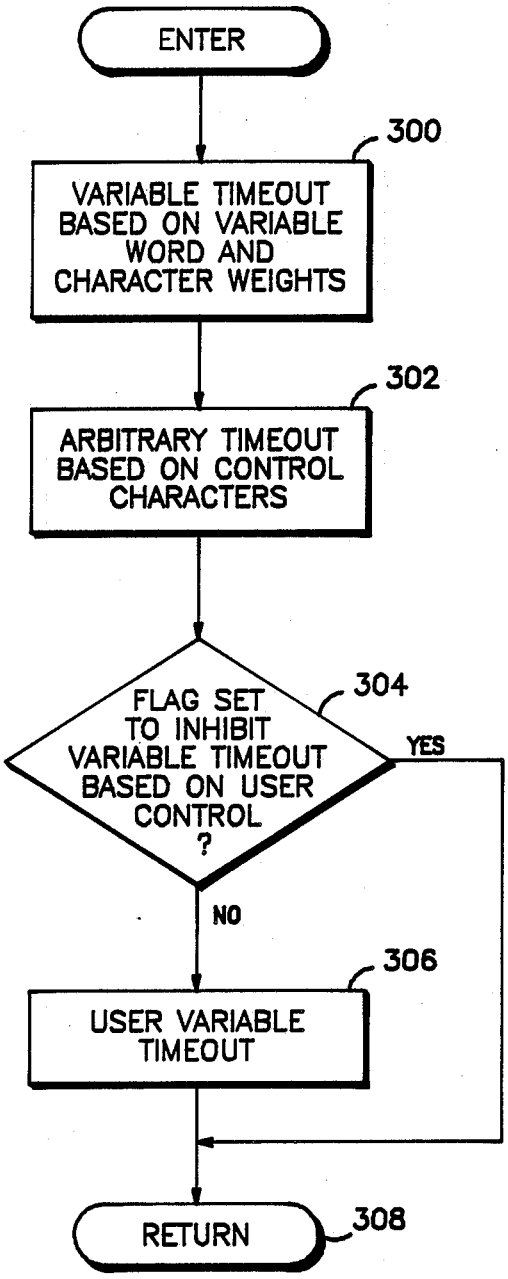
FIG. 9 is a flow chart describing the operation of the microprocessor for computing a variable screen timeout value for each screen.

Referring to FIG. 9, there is shown a flow chart for computing the screen timeout value of step 158 of FIG. 6. The flow chart of FIG. 9 illustrates three different methods for computing a variable screen timeout value. The first method computes a variable screen timeout value based upon message content, step 300. The second method computes a variable screen timeout value based on control signals, such as control character embedded in the message of control signals or generated by the code plug memory, step 302. The third method determines a screen variable timeout value by sensing activation of at least one control switch, steps 304–306. The variable screen timeout value based upon sensing control switches can be disabled if a flag is set by a special control character present in the message to be displayed, step 304. This override feature insures that an important message can be intelligently presented to the paging user.

1. Variable Timeout Based Upon Message Content

Figure 10:
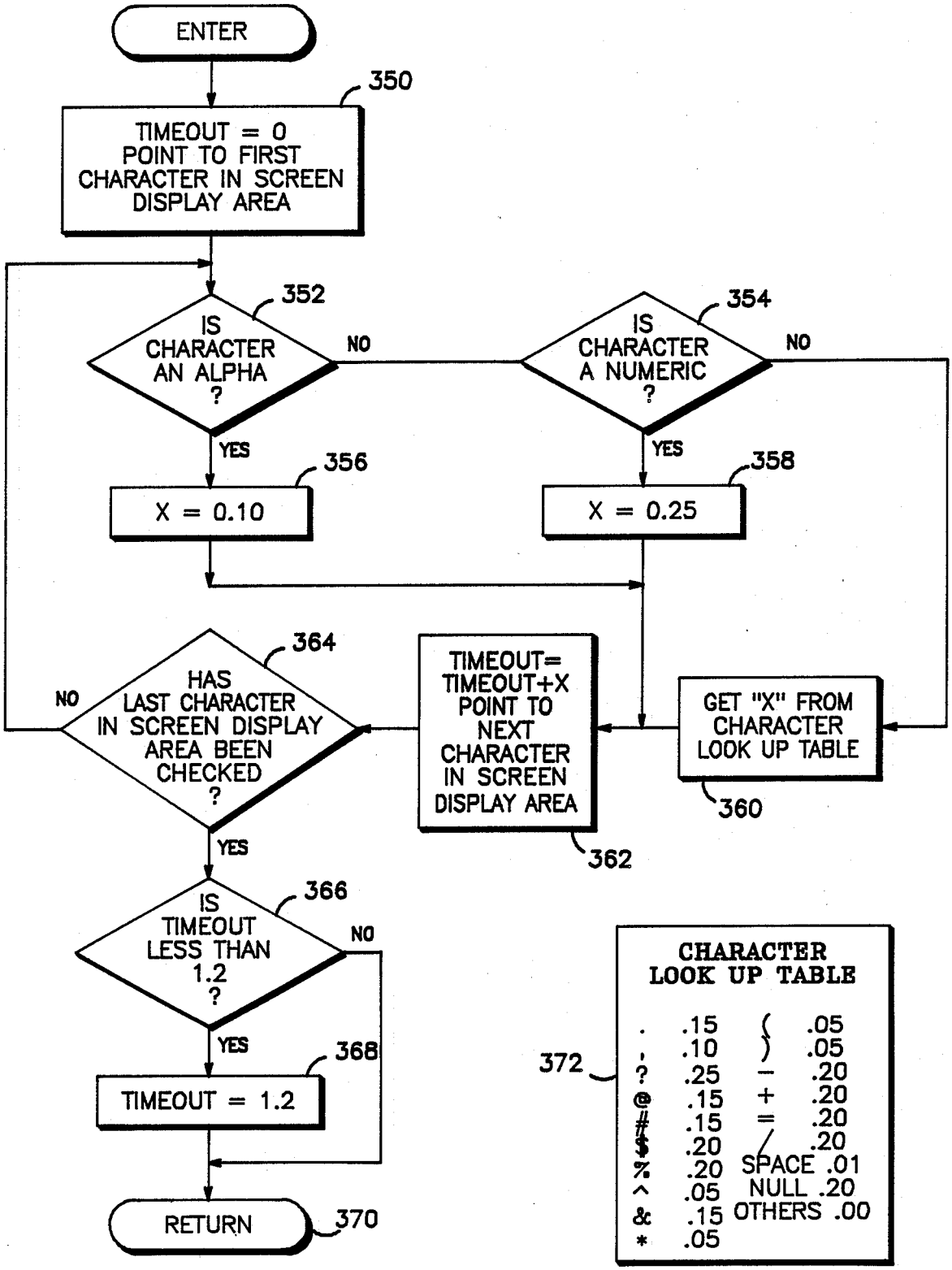
FIG. 10 is a flow chart describing the method of computing a variable screen timeout value based upon message content.

Referring to FIG. 10, there is shown a detailed flow chart for computing the variable screen timeout value based upon message content as shown in step 300 of FIG. 9. The method begins by setting the screen timeout value equal to zero and pointing to the first character in the screen display area, step 350. It is important to remember that the screen display area comprises a sequence of characters from the message to be displayed. In general, the method determines the nature or type of each character in the screen display area and adds a predetermined incremental timeout value to the screen timeout value, depending upon the type of each character. The type of the character includes alpha characters such as A, B, C, D, . . . ; numeric characters such as 0, 1, 2, 3, . . . 9; or predetermined special characters such as *, =, /, etc. In step 352, it is determined whether the character is an alpha character. If the character is an alpha character, then the screen timeout value is incremented by a predetermined incremental time value "X" such as 100 milliseconds, step 356. The predetermined incremental time value "X" can be any value, however, it typically is dependent upon such variables as the number of display elements.

Referring back to step 352, if the character is not an alpha character, it is determined whether the character is a numeric character, step 354. If the character is a numeric character, this, in all probability, signifies that a telephone number or other important data is embedded in the message. Thus, the incremental timeout value for a numeric character is different than the incremental timeout value for an alpha character. In this case, if the character is numeric, the timeout value is increased by a greater amount than the predetermined incremental timeout value "X" for the alpha character. The reason is that numeric data embedded in a paging message is usually a telephone number or some other important data which the user usually desires to copy. Therefore, the predetermined incremental timeout value "X" such as 250 millisecond increments the screen timeout value, step 358.

Referring back to step 354, if the character is neither numeric nor alpha, then the character is a special character and the predetermined incremental timeout value "X" is determined from a character lookup table, step 360. Referring to block 372, an example of a character lookup table with appropriate values of "X" is shown. For example, the space character has an incremental timeout value of 10 milliseconds signifying that the user does not require much time to read a space. Considering the lookup table in somewhat further detail, note that the algebraic signs are given a longer incremental timeout value because it would be desirable to display an equation longer than an alphanumeric message. As is evident, the screen timeout value is determined upon the message complexity and content as determined by steps 352–360.

The screen timeout value is then incremented by the incremental timeout value, step 362. The address pointer in the screen display area is then incremented to retrieve the next character in the screen display area, step 362. It is then determined whether the next character in the screen display area is the last character, and if not, the next character is retrieved, step 364. If the last character in the screen display area has been checked, the method then insures a minimum screen timeout value is computed. If the screen timeout value is less than a predetermined value, the screen timeout value is set to a minimum value such as 1.2 seconds, steps 366–368. The method then returns, step 370. Pursuing the example of FIGS. 3A–C, the following table gives the timeout values for the screens.

| FIG. | Alpha | Numeric | Special | Timeout Value |
|---|---|---|---|---|
| 3A | 11 × .10 | | 0.01 (space) | 1.11 sec. |
| 3B | 2 × .10 | 7 × .25 | 2 × .01 (space)<br>.20 hyphen | 2.17 sec. |
| 3C | 11 × .10 | | 0.01 (space) | 1.11 sec. |

As is clearly evident, since FIG. 3B includes a telephone number, the computed timeout value is greater (2.17 sec.) than the timeout value for the screens of FIG. 3A or 3C (1.11 sec.).

2. Variable Timeout Based Upon Control Characters

Figure 11:
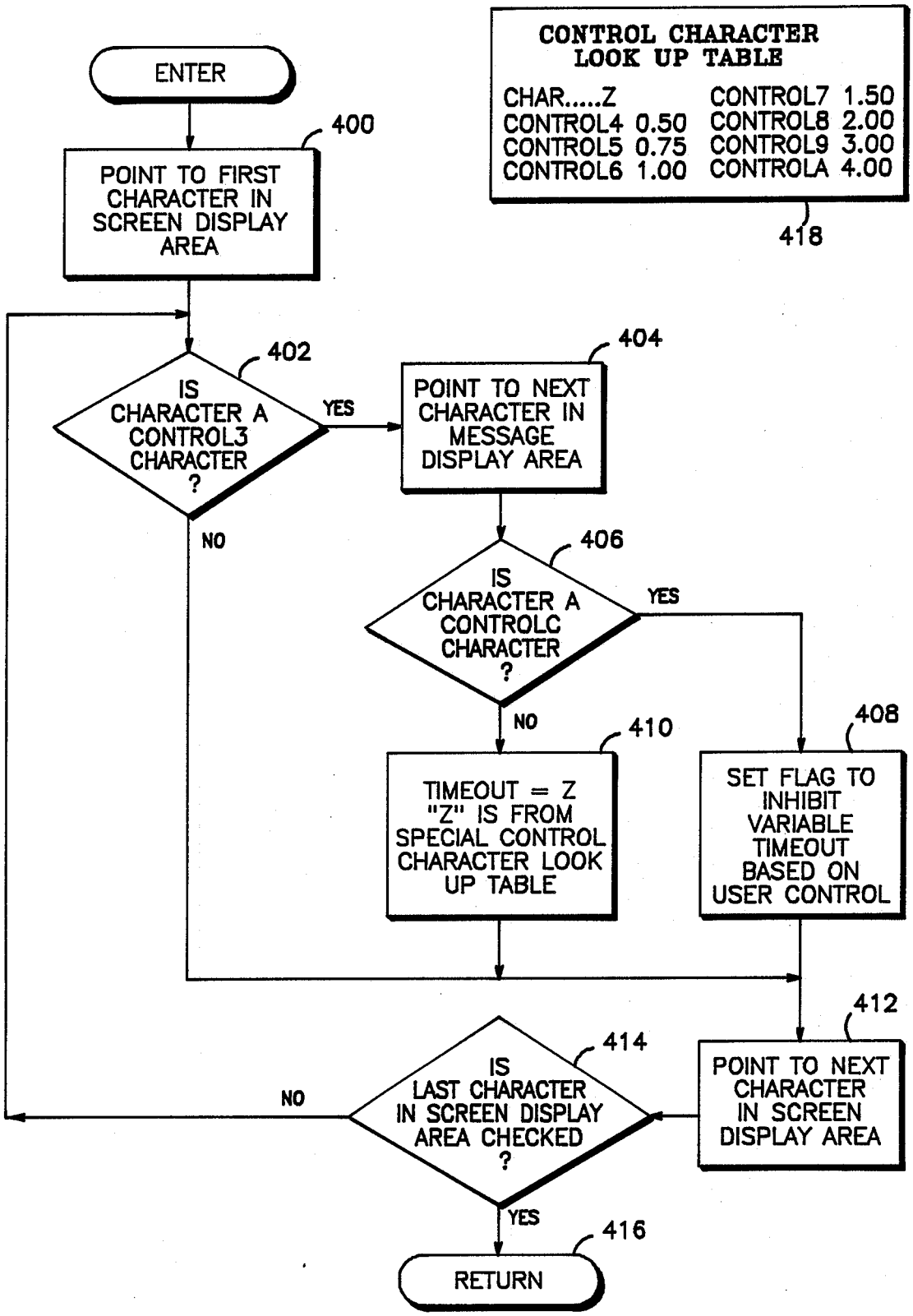
FIG. 11 is a flow chart describing the method of computing a variable screen timeout value based upon control characters embedded in the message.

Referring to FIG. 11, there is shown the computation of the variable screen timeout value based upon control characters as shown in step 302 of FIG. 8. The routine begins by retrieving the first character in the screen display area, step 400. Next, it is determined whether the character is a special predetermined character such as a control three character, step 402. In the illustrated embodiment, a control three character notifies the method that the following character contains information for determining the screen timeout value. If the character is a control three character, then the address pointer in the screen display area is pointed to the next character, step 404. It is then determined if the next character is a second special predetermined character such as a control C character, step 406. If the character is a control C character, a flag is set to inhibit the variable timeout based on activation of the control switches, step 408. If the next character is not a control C character, the next character will be one of a plurality of control characters in which a screen timeout value "Z" is associated with a corresponding control character via a lookup table as illustrated in block 418. The screen timeout value is set to the timeout value "Z" corresponding to the control character, step 410. The address pointer is then set to retrieve the next character in screen display area, step 412. It is then determined whether the last character in the screen display area has been checked, step 414. If it is not the last character, the procedure repeats again with steps 400–414 searching for another special predetermined character such as a control three character.

Please note that the last control three character will control the final timeout value for the screen. Referring back to step 414, eventually the last character in the screen display area is checked and the method exits, step 416. As an example of the above method, if the screen display area includes a control three character followed by a control A character, the timeout value for the screen would be set to four seconds.

3. Variable Timeout Based Upon External Control Signals

Referring to FIG. 12, there is shown the routine for computing the variable screen timeout value of step 306 of FIG. 9. The routine begins by determining if the user is requesting a faster scroll rate by sensing the fast switch on the paging receiver, step 450. If the user does request a faster scroll rate, the screen timeout value is decreased by a predetermined percentage or amount, such as 90%, step 452. The screen timeout value is then set to the timeout value as requested by the user, step 458.

Referring back to step 450, if a faster scroll rate is not requested, it is determined whether a slower scroll rate is requested, step 454. If a slower scroll rate is requested, then the screen timeout value is incremented by a predetermined percentage or amount, such as 10%, step 456. The system then sets the screen timeout value to the timeout as requested, step 458. Note that if a faster or slower scroll rate is not requested, the screen timeout value remains unchanged. The system then returns, step 462.

Referring to FIG. 13B, there is illustrated a method for setting the screen timeout value from the code plug memory. In this method, a third special control character such as a control B is embedded within the message by the base station terminal processing. The method checks for this special control character, step 470. If the character is found, a predetermined screen timeout value is retrieved from the code plug memory, step 472. The screen timeout value is then set to the retrieved value, step 474. As is evident, this method permits the base station to override the user variable timeout. As an example, a very important message, such as an emergency message, overrides any user requested timeout value and is displayed for an appropriate length of time to notify the paging receiver user.

4. Computation of Variable Screen Timeout on a Combination of Previous Methods

Figure 14:
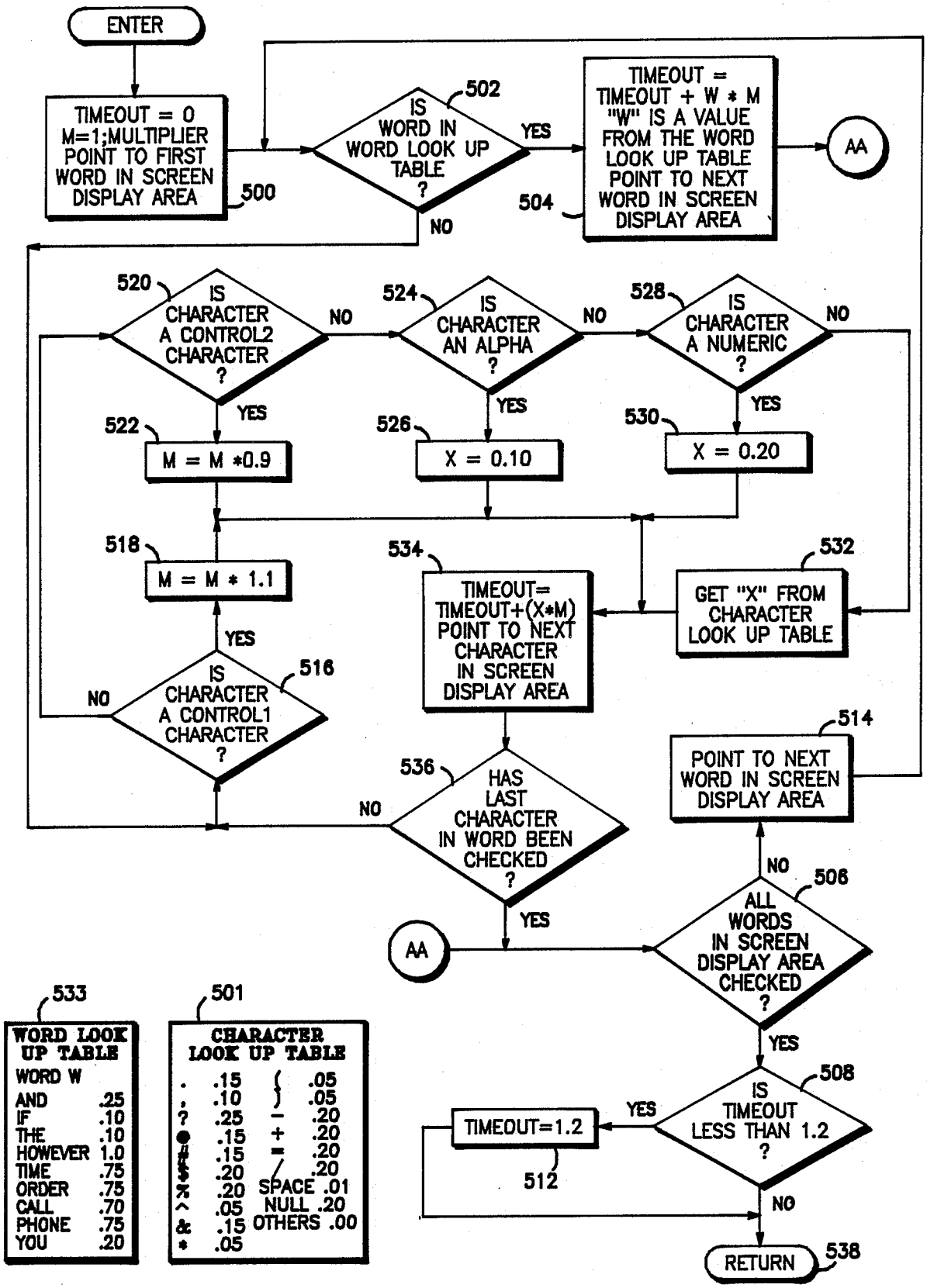
FIG. 14 is a flow chart describing a method for computing a timeout value based upon the methods of FIGS. 9–13.

Referring to FIG. 14 there is shown a method for computing a screen timeout value based upon message content, word content, character type, and control characters. The method begins by setting the screen timeout value to zero, setting a multiplier "M" equal to one and retrieving the first word from the screen display area, step 500. The first word, comprised of a plurality of characters, is then compared to a word lookup table, step 502. An example of a word lookup table is shown in block 501. If the word is in the word lookup table, then the screen timeout value is determined on the basis of W and M where W corresponds to the word from the lookup table and M is a multiplier, step 504. For example, if the screen display area includes the word "PHONE", the screen timeout value is computed based upon the presupposition that the word following "PHONE" is a number. In this example from block 501, W is set to 0.75 and M set to 1.0, giving a screen timeout value of 0.75 seconds.

The method then retrieves the next word in the screen display area, step 504. The method continues by determining if this is the last word in the screen display area, step 506. If it is, then the method returns after checking to insure a minimum screen timeout value has been calculated, steps 508–512. If this is not the last word in the screen display area, then the address pointer is set to the next word in the screen display area and the procedure repeats, step 514.

Referring back to step 502, if the word is not in the word lookup table, then the characters of the word are checked for determining a screen timeout value. The first character of the word is checked to see if the character is a fourth special control character such as control one character, step 516. If the character is a control one character, the multiplier factor is increased by a predetermined percentage or amount, step 518. If the character is not a control 1 character, then it is determined whether the character is a fifth special control character such as a control 2 character, step 520. If the character is a control 2 character, then the multiplier is decremented by a predetermined percentage or amount, step 522. As is evident, steps 516–522 provide a method for increasing or decreasing the timeout multiplier by embedding a corresponding control characters in the message.

If the character is neither a control one nor a control two character, then it is determined whether the character is an alpha character, step 524. If the character is an alpha character, then the screen timeout value is increased by a predetermined incremental screen timeout value such as 100 milliseconds, step 526. If the character is not an alpha character, then it is determined whether the character is a numeric character, step 528. If the character is a numeric character, then the incremental screen timeout value is increased by a different amount such as 250 milliseconds, step 530. As was explained earlier, the greater incremental timeout value for a numeric character assumes that the numeric character is a phone number or address or some other important information. If the character is neither an alpha nor a numeric character, then the screen timeout value is set equal to the timeout value from a special character lookup table as illustrated in block 533 and as described previously with respect to FIG. 10, step 532. The screen timeout value is then modified on the basis of the incremental timeout value and the multiplier "M", step 534. After determining the screen timeout value, the method then retrieves the next character in the word, step 536. If the word contains another character, the system then repeats from steps 500 through 534. Referring back to step 536, if the last character in the word has been checked, then it is determined whether this is the last word in the screen display area, step 506. If the last character in the last word has been checked, then the method checks to insure a minimum screen timeout value has been computed and returns, steps 508–512.

Thus, there has been shown a method and apparatus for determining a variable scroll rate for a display of a paging receiver. The scroll rate of the display is determined by the complexity of the information content of a particular message in storage, by user input, by control characters embedded in the message, or by external control signals. The scroll rate is adjusted by the information and by the user for displaying the message in a easy, friendly manner.

It will, of course, be understood by those skilled in the art that the particular embodiments of the invention here shown are by way of illustration only and are meant to be in no way restrictive; therefore, numerous changes in the full use of equivalence resorted to without departing from the spirit and scope of the invention are as defined by the appended claims.

We claim:

1. A method for controlling a scroll rate of a paging receiver display, the display having a predetermined number of displayable characters and the paging receiver capable of storing a plurality of received data messages in a memory, each data message being comprised of a plurality of alphanumeric characters, said method comprising the steps of:

(a) selecting a data message to display from the memory;

(b) arranging the data message into a plurality of screens, wherein each screen comprises a sequence of data message characters;

(c) computing a separate screen timeout value for each screen on the basis of the entire informational content of the sequence of characters comprising each screen;

(d) determining whether each character of the sequence of characters comprising each screen is a numeric, an alpha or a special character; (e) adding a first predetermined incremental timeout value to the screen timeout value for a numeric character included in the sequence of characters comprising each screen;

(f) adding a second predetermined incremental timeout value to the screen timeout value for an alpha character included in the sequence of characters comprising each screen;

(g) adding a third predetermined incremental timeout value to the screen timeout value for a predetermined special character included in the sequence of characters comprising each screen; and (h) displaying each screen in a predetermined order on the paging receiver display for the screen timeout value computed.

2. The method of claim 1, wherein the paging receiver includes at least one control switch and wherein step (c) of computing further comprises the steps of:

(i) sensing the activation of the control switch and generating an input signal in response thereof; and (j) modifying the screen timeout value in response to the input signal.

3. The method of claim 2, wherein step (j) of modifying further includes the step of:

(k) increasing the screen timeout value by a predetermined percentage to decrease the scroll rate.

4. The method of claim 2, wherein step (j) of modifying further includes the step of:

(l) decreasing the screen timeout value by a predetermined percentage to increase the scroll rate.

5. The method of claim 1, wherein the paging receiver includes at least one control switch and wherein step (c) of computing further comprises the steps of:

(m) sensing activation of the control switch and generating an input signal in response thereof;

(n) computing in response to the input signal, the magnitude of an incremental screen timeout value; and (o) modifying the screen timeout value according to the incremental screen timeout to change the scroll rate.

6. The method of claim 1, wherein the paging receiver further includes a reverse switch, and wherein the method further includes the steps of:

(p) sensing activation of the reverse switch and generating a reverse input signal in response thereof; and (g) reversing the order of the screens, in response to the reverse input signal, such that previously displayed screens are displayed from a most recently displayed screen to a least recently displayed screen.

7. A method for controlling a scroll rate of a paging receiving display, the display having a predetermined number of displayable characters and the paging receiver capable of storing a plurality of received data messages in a memory, each data message being comprised of a plurality of alphanumeric characters, said method comprising the steps of:

(a) selecting a data message to display from the memory;

(b) arranging the data message into a plurality of screens, wherein each screen comprises a sequence of data message characters;

(c) comparing the sequence of characters comprising each screen to a predetermined set of control characters;

(d) computing a separate screen timeout value for each screen on the basis of the entire informational content of the sequence of characters comprising each screen;

(e) adding a predetermined incremental timeout value to the screen timeout value, depending upon the presence of a control character from the predetermined set of control characters in the sequence of characters comprising each screen; and (f) displaying each screen in a predetermined order on the paging receiver display for the screen timeout value computed.

8. A method for controlling a scroll rate of a paging receiver display, the display having a predetermined number of displayable characters and the paging receiver capable of storing a plurality of received data messages in a memory, each data message being comprised of a plurality of alphanumeric characters, said method comprising the steps of:

(a) selecting a data message to display from the memory;

(b) arranging the data message into a plurality of screens, wherein each screen comprises a sequence of data message characters;

(c) comparing the sequence of characters in each screen to a predetermined control character;

(d) retrieving a timeout value from the memory, corresponding to the presence of the predetermined control character;

(e) setting a screen timeout value to the timeout value retrieved from the memory; and (f) displaying each screen in a predetermined order on the paging receiver display for the screen timeout value set.

9. A method for controlling a scroll rate of a paging receiver display, the display having a predetermined number of displayable characters and the paging receiver capable of storing a plurality of received data messages in a memory, each data message being comprised of a plurality of alphanumeric characters, said method comprising the steps of:

(a) selecting a data message to display from the memory;

(b) arranging the data message into a plurality of screens, wherein each screen comprises a sequence of data message characters;

(c) computing a separate screen timeout value for each screen on the basis of words comprising each screen, said step of computing comprising:

(i) comparing each word of each screen to a predetermined set of words;

(ii) retrieving a timeout value from the memory corresponding to the presence of a predetermined word; and (iii) incrementing the screen timeout value by the timeout value retrieved from the memory; and (d) displaying each screen in a predetermined order on the paging receiver display for the screen timeout value computed.

10. A method for controlling a scroll rate of a paging receiver display, the display having a predetermined number of displayable characters and the paging receiver having a code plug memory capable of storing predetermined values and a memory capable of storing a plurality of received data messages, each data messages being comprised of a plurality of alphanumeric characters, said method comprising the steps of:

(a) selecting a data message to display from the memory;

(b) arranging the data message into a plurality of screens, wherein each screen comprises a sequence of data message characters;

(c) comparing the sequence of characters in each screen to a predetermined control character;

(d) retrieving a timeout value from the code plug memory upon detecting the predetermined control character;

(e) setting a screen timeout value for each screen to the timeout value retrieved from the code plug memory; and (f) displaying each screen in a predetermined order on the paging receiver display for the screen timeout value.

11. A method for controlling a paging receiver display, the display having a predetermined number of displayable characters and the paging receiver having a memory for storing a plurality of received data messages, each data message comprised of a plurality of alphanumeric characters, the paging receiver further having a first control switch for controlling the operation of the paging receiver, said method comprising the steps of:

(a) sensing the activation of the first control switch and generating a first input signal in response thereof;

(b) selecting a data message in response to the first input signal to display a data message chosen from the memory;

(c) arranging the data message into at least one screen of a plural population of screens, wherein the screen comprises a sequence of characters from the data message;

(d) arranging the characters in the screen into a word group such that each word of the group remains unbroken and such that each screen has a plurality of words;

(e) computing a screen timeout value for the screen on the basis of the characters within at least two words; and (f) displaying the screen, in a predetermined order on the paging receiver display, for the screen timeout value computed.

12. The method of claim 11, wherein the paging receiver includes a second control switch and further including the steps of:

(g) sensing the activation of the second control switch and generating a second input signal in response thereof; and (h) modifying the screen timeout value in response to the second input signal.

13. The method of claim 12, wherein step (h) of modifying further includes the step of:

(i) increasing the screen timeout value by a predetermined amount.

14. The method of claim 12, wherein step (h) of modifying further includes the step of:

(j) decreasing the screen timeout value by a predetermined amount.

15. The method of claim 12, further including the steps of:

(k) comparing the sequence of characters in the screen to a predetermined control character;

(l) inhibiting the modification of the screen timeout value by the second input signal upon detecting the presence of the predetermined control signal;

(m) retrieving a timeout value from the memory corresponding to the presence of the predetermined control character; and (n) setting the screen timeout value to the timeout value retrieved from the memory.

16. The method of claim 11, wherein the paging receiver further includes a reverse switch and wherein the method further includes the steps of:

(o) sensing activation of the reverse switch and generating a reverse input signal in response thereof; and (p) reversing the order of the screen in response to the reverse input signal.

17. The method of claim 11, wherein step (e) of computing further includes the steps of:

(q) determining the type of each character of the sequence of characters comprising the screen; and (r) incrementing the screen timeout value by a predetermined incremental timeout value corresponding to the type of character.

18. The method of claim 11, wherein step (e) of computing further includes the steps of: predetermined set of words;

(t) retrieving a timeout value from the memory corresponding to the presence of the predetermined word; and (u) incrementing the screen timeout value by the timeout value retrieved from memory.

19. A device for displaying data from a paging receiver, the paging receiver including a memory for storing a plurality of received data messages, each data message being comprised of a plurality of alphanumeric characters, the device comprising:

means for selecting a data message to display from the memory;

means for arranging the data message into a plurality of screens, wherein each screen comprises at least a first sequence of data message characters and a second sequence of data message characters wherein the separation between the first and second sequences comprises a space data message character;

means for computing a separate screen timeout value for each screen on the basis of characters within the at least first and second sequences; and means for displaying each screen in a predetermined order for the screen timeout value computed.

20. The device of claim 19, wherein the computing means further:

determines the type of each character of the sequence of characters comprising each screen; and adds a predetermined incremental timeout value to the screen timeout value, depending upon the type of each character.

21. The device of claim 19, wherein the computing means further:

compares the characters comprising each screen to a predetermined set of control characters; and adds a predetermined incremental timeout value to the screen timeout value, depending upon the presence of a control character from the predetermined set of control characters in the sequence of characters comprising each screen.

22. The device of claim 19, further including at least one control switch for generating an input signal and wherein the computing means, in response to the input signal, modifies the screen timeout value.

23. The device of claim 19, further including a reverse switch for generating a reverse input signal, wherein the computing means, in response to the reverse input signal, reverses the order of the screens.

24. The device of claim 19, wherein the computing means further:

compares the sequence of characters in each screen to a predetermined control character;

retrieves a timeout value from the memory, corresponding to the presence of the predetermined control character; and sets the screen timeout value to the timeout value retrieved from the memory.

25. The device of claim 19, wherein the computing means further:

compares each sequence of characters of each screen to a predetermined set of sequence of characters;

retrieves a timeout value from the memory corresponding to the presence of a predetermined sequence of characters; and increments the screen timeout value by the timeout value retrieved from the memory.

26. The device of claim 19, further including a code plug memory capable of storing predetermined values, and wherein the computing means:

compares the sequence of characters in each screen to a predetermined control character;

retrieves a timeout value from the code plug memory upon detecting the predetermined control character; and sets the screen timeout value to the timeout value retrieved from the code plug memory.

27. A device for displaying data from a paging receiver display, the display having a predetermined number of displayable characters and the paging receiver capable of receiving a plurality of data messages, each data message being comprised of a plurality of alphanumeric characters, the device comprising:

means for selecting a data message to display from the memory;

means for arranging the data message into a plurality of screens, wherein each screen comprises a sequence of data message characters and wherein each data message character is arranged into only one of the plurality of screens;

means for computing a separate screen timeout value for each screen on the basis of the data message characters within the screen; and means for storing each screen with the corresponding screen time out value in a predetermined order.

28. The device of claim 27, further including:

means for displaying each screen for the screen timeout value computed.

29. The device of claim 27, further including a reverse switch for generating a reverse input signal, wherein the computing means, in response to the reverse input signal, recalls the screens from the storage means and reverses the order of the screens for effecting a display of the screens in a reverse order.

30. A method of controlling a scroll rate of a paging receiver display, the display having a predetermined number of displayable characters and the paging receiver capable of storing a plurality of received data messages in a memory, each data message being comprised of a plurality of alphanumeric characters, said method comprising the steps of:

(a) selecting a data message to display from the memory;

(b) arranging the data message into a plurality of screens, wherein each screen comprises a sequence of data message characters and wherein each data message character is arranged into only one of the plurality of screens;

(c) storing each screen in a predetermined order in the memory; and (d) computing a separate screen timeout value for each screen on the basis of the data message characters within the screen; and (e) storing the screen timeout value with the corresponding screen in the memory.

31. The method of claim 30, further including the step of:

(f) displaying each screen on the paging receiver display for the screen timeout value computed.

32. The method of claim 31, wherein the paging receiver further includes a reverse switch, and wherein the method further includes the steps of:

(g) sensing activation of the reverse switch and generating a reverse input signal in response thereof;

(h) recalling the screens with the corresponding screen timeout value memory in response to the reverse input signal; and (i) displaying the screens in the reverse order.

33. A method for controlling a scroll rate for a display device having a readable display and a selectable read control, the display device being responsive to a memory for storing at least one screen for a data message, the data message comprising a plurality of character sequences, wherein the separation between each character sequence comprises a space character, said method comprising the steps of:

(a) arranging the data message into the at least one screen, wherein the screen comprises a plurality of character sequences from the data message;

(b) computing a screen timeout value for each of the at least one screen on the basis of at least two character sequences;

(c) storing each of the at least one screen in the memory with the corresponding screen timeout value computed; and (d) repeating step (a) of rearranging through step (c) of displaying unit the at least one screen of the data message is stored; and (e) displaying the at least one screen in a predetermined order for the screen timeout value computed in response to the selectable read control.

34. The method of claim 33, wherein step (b) of computing further comprises the step of:

(e) computing the screen timeout value on the basis of all of the characters in each of the character sequences of the screen.

35. A display device for displaying a data message included in a memory, the data message being comprised of a plurality of displayable characters, the display device comprising:

means for arranging the data message into at least one screen, wherein a screen comprises a sequence of displayable characters from the data message;

means for identifying a character type for characters comprising the screen, wherein said identifying means identifies at least three character types and wherein at least one of said three character types is numeric;

means for determining a screen timeout value, depending upon the type character of each identified character; and means for displaying the screen for the duration of the screen timeout value computed.

36. A display device for displaying a data message included in a memory, the data message being comprised of a plurality of displayable characters, the display device comprising:

means for arranging the data message into at least one screen, wherein a screen comprises a sequence of displayable characters from the data message;

means for identifying a character type for characters comprising the screen, wherein said identifying means identifies at least three character types and wherein at least one of said three character types is an alpha character;

means for determining a screen timeout value, depending upon the type character of each identified character; and means for displaying the screen for the duration of the screen timeout value computed.

37. A display device for displaying a data message included in a memory, the data message being comprised of a plurality of displayable characters, the display device comprising:

means for arranging the data message into at least one screen, wherein a screen comprises a sequence of displayable characters from the data message;

means for identifying a character type for characters comprising the screen, wherein said identifying means identifies at least three character types and wherein at least one of said three character types is a nondisplayable control character;

means for determining a screen timeout value, depending upon the type character of each identified character; and means for displaying the screen for the duration of the screen timeout value computed.

* * * * *